US006267057B1

(12) United States Patent
Albert

(10) Patent No.: US 6,267,057 B1
(45) Date of Patent: Jul. 31, 2001

(54) METHOD AND APPARATUS FOR CONTROL COMMAND AUTOMATION IN A CUSTOMIZABLE PRINTING PRESS

(75) Inventor: Kevin Francis Albert, Barrington, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/504,125

(22) Filed: Feb. 15, 2000

(51) Int. Cl.[7] ..... B41C 47/60; B41F 1/34
(52) U.S. Cl. ..... 101/483; 101/485
(58) Field of Search ..... 101/483, 485

(56) References Cited

U.S. PATENT DOCUMENTS 4,639,881 * 1/1987 Zingher ..... 364/521
5,363,446 * 11/1994 Ruppertz et al. ..... 380/4
5,461,560 * 10/1995 Uribe ..... 364/188
5,678,482 * 10/1997 Daniel et al. ..... 101/129
5,875,288 * 2/1999 Bonstein et al. ..... 395/109
5,937,149 * 8/1999 Lindner et al. ..... 395/113

* cited by examiner

*Primary Examiner*—John S. Hilten
*Assistant Examiner*—Charles H. Nolan, Jr.
(74) *Attorney, Agent, or Firm*—Kenyon & Kenyon

(57) ABSTRACT

A method and apparatus for automating input of parameter changes on a printing press. At least one sequence of parameter change inputs is recorded and stored in a predetermined file. Later, the file may be called up and the recorded sequence of parameter change inputs played back so as to automatically control the printing press. Operational consistency and operator convenience are enhanced.

13 Claims, 2 Drawing Sheets

METHOD AND APPARATUS FOR CONTROL COMMAND AUTOMATION IN A CUSTOMIZABLE PRINTING PRESS

FIELD OF THE INVENTION

The invention relates generally to printing presses, and more particularly to the control of a printing press using parameter change commands.

RELATED TECHNOLOGY

In a typical lithographic printing press various parameters are monitored and varied as necessary to control the operation of the press. Such parameters include ink and water values, register, and web speed and web tension. A graphical user interface (GUI) is often used in modem presses for parameter control. Parameter control is effected through series of manual mouse movements and clicks and keystrokes. Repetitive operations performed on a press require repetitive manual sequences of parameter change inputs on the GUI. Presetting of press functions is known, whereby preset machine state is stored and then called up to restore the press parameters to the preset state.

SUMMARY OF THE PRESENT INVENTION

The present invention provides for automatic input of parameter changes on a printing press. At least one sequence of parameter change inputs are recorded, for example via a GUI, and may be played back at later time so as to control the printing press.

The present invention also provides an apparatus for automating input of parameter changes on a printing press, the apparatus comprising a recording and storage device for recording and playing back at least one sequence of parameter change inputs, and a processor for controlling the recording and playing back of the at least one sequence of parameter change inputs.

BRIEF DESCRIPTION OF THE DRAWINGS

The present invention will be described with reference to the following figures.

DETAILED DESCRIPTION

Figure 1:
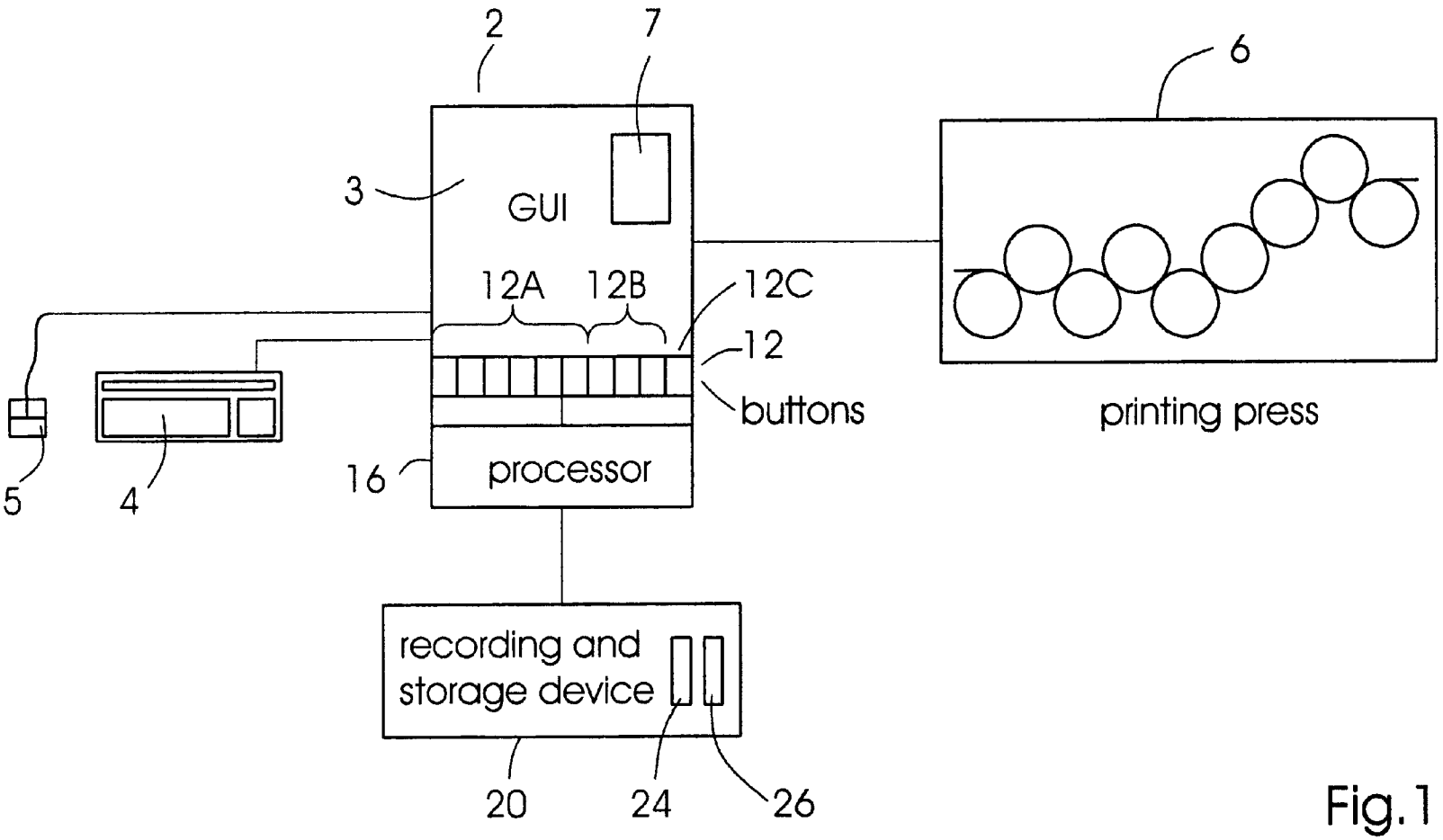
FIG. 1 shows a schematic diagram of an apparatus for automating input of parameter changes on a printing press.

FIG. 1 shows graphical user interface (GUI) 2 for controlling the operation of customizable printing press 6. GUI 2 includes screen 3, keyboard 4, and mouse 5. Keyboard 4 and mouse 5 are used for entering parameter change commands via GUI 2 to control the operation of printing press 6. In addition to typical press control icons (not shown), graphical function buttons 12 are displayed on screen 3 of the GUI. Graphical function buttons 12 include saved sequence buttons 12A, workshift buttons 12B and record button 12C. Recording and storage device 20 is connected to processor 16. Processor 16 is connected to GUI 2.

Figure 2:
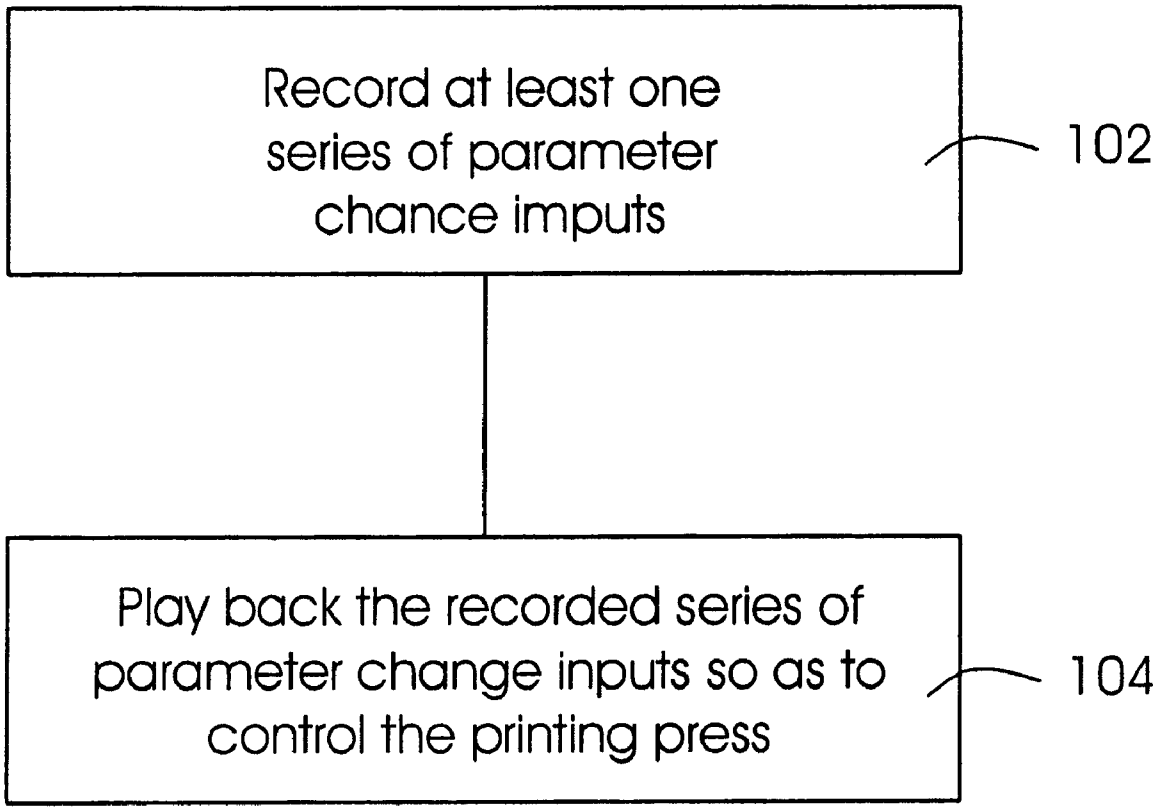
FIG. 2 shows a flow chart of a method according to the present invention.

FIG. 2 shows a flow chart of a method according to the present invention. As shown in block 102, at least one sequence, or series, of parameter change inputs is recorded. The recorded sequence of parameter change inputs is then played back so as to control the printing press, as indicated in block 104. The sequence of parameter changes, preferably entered via GUI 2 using keyboard 4 and/or mouse 5, are recorded by recording and storage device 20 as recorded parameter change sequence file 24 residing on the device. Processor 16 executes program 26, preferably stored on recording and storage device 20, to control the recording and playing back of the sequence of parameter changes.

Graphical function buttons 12 on GUI screen 3 are used to enter record and playback commands, as well as to assign a given sequence of parameter change inputs to a particular file and to the set of files for a particular press operator workshift. Record button 12C is used to commence recording of parameter change inputs. Upon activating button 12C, a dialog box 7 is presented on screen 3. Dialog box 7 prompts the inputting of a file name for recorded parameter change sequence file 24 in which the immediately subsequent parameter change input sequence will be stored. A parameter change sequence is then recorded, including mouse movements, mouse clicks and keystrokes. When recording is finished, one of saved sequence buttons 12A is activated to assign the recorded parameter change sequence file 24 to that button. Later, until such time as a new file is recorded to that button, activating the button will cause file 24 to be played back and the parameter changes saved therein to be automatically input via GUI 2 to control printing press 6. Activating one of shift buttons 12B retrieves a unique set of saved sequence buttons 12A so that each operator work shift for printing press 6 may save and play back its own customized set of parameter change sequence files.

The present invention therefore enables a sequence of command change inputs to be recorded and then automatically called-up and effected to control the printing press without the need to manually enter each input in the sequence. Operator convenience, as well as consistency of press operation may be thereby enhanced.

GUI 2 is preferably a graphical interface having a human machine interface layout. Alternatively, GUI 2 may be any other type of graphical interface for controlling a customizable printing press. Inputs to GUI 2 may in other embodiments of the invention be via any of various user input devices, such as light pens, track balls, etc.

Graphical function buttons 12 may be any type of graphical action-activating ikons displayed on GUI 2. Preferably the buttons are linked to program 26 residing on recording and storage device 24 and executed by processor 16, in a manner which will be known to those skilled in the art. Preferably, at least ten saved sequence buttons 12A, at least three workshift buttons 12B, and one record button 12C are provided.

Processor 16 is preferably a Von-Neumann type processor. It may be located in the machine on which the code is being executed, or may be located elsewhere.

Program 26 is preferably written in an object-oriented programming language, such as C++. Any conventional programming language may be used, however. Writing steps for such a program is within the ability of those skilled in the art.

Recording and storage device 20 is preferably a magnetic or optical disc drive. In other embodiments of the invention storage device 20 may be any other suitable device, such as a magnetic tape drive, for storing program 26 and recorded command change sequence file 24.

It should be understood that variations may be made in specific embodiments which are intended to be within the scope of the present invention. For example, the present invention is not intended to be limited to command change inputs via a GUI. Change inputs may be entered via other types of user command input devices, such as keyboards, etc. Additionally, various types of hardware platforms and software may be used to implement the present invention. The present invention is limited only by the scope of the attached claims.

What is claimed is:

1. A method for automating input of device control commands and/or parameter changes on a printing press, the method comprising:

recording at least one sequence of device control command and/or parameter change inputs;

playing back the recorded at least one sequence of device control command and/or parameter change inputs so as to control the printing press;

entering the at least one sequence of device control command and/or parameter change inputs via a graphical user interface (GUI); and assigning each of the recorded at least one sequence of device control command and/or parameter change inputs to an associated predetermined playback button for initiating the playing back of the associated at least one sequence of device control command and/or parameter change inputs.

2. The method as recited in claim 1 wherein the at least one sequence of parameter change inputs are recorded in a file on at least one of a magnetic disc, a magnetic tape and an optical disk.

3. The method as recited in claim 1 wherein the at least one sequence of parameter change inputs includes mouse movements, mouse clicks and keystrokes.

4. The method as recited in claim 1 wherein each predetermined playback button is associated with a predetermined shift button, the predetermined shift button corresponding to a predetermined work shift of the printing press.

5. The method as recited in claim 1 wherein the recording step is initiated using a record button associated with the GUI.

6. The method as recited in claim 1 wherein recording and playing back are controlled by a processor executing a program.

7. The method as recited in claim 6 wherein the program is stored in a file on at least one of the magnetic disc, the magnetic tape and the optical disk.

8. An apparatus for automating input of device control commands and/or parameter changes on a printing press, the apparatus comprising:

a recording and storage device for recording and playing back at least one sequence of device control command and/or parameter change inputs;

a processor for controlling the recording and playing back of the at least one sequence of device control command and/or parameter change inputs;

a graphical user interface (GUI) through which the at least one sequence of device control command and/or parameter change inputs are entered;

a plurality of graphical function buttons shown on the graphical user interface (GUI), wherein the plurality of graphical function buttons include at least one playback button, each of the at least one playback button corresponding to an associated one of the recorded at least one sequence of device control command and/or parameter change inputs.

9. The apparatus as recited in claim 8 wherein the recording and storage device includes at least one of a magnetic disc drive, a magnetic tape drive and an optical disk drive.

10. The apparatus as recited in claim 8 wherein the processor is capable of executing a program for controlling the recording and playing back of the at least one sequence of parameter change inputs.

11. The apparatus as recited in claim 10 wherein the program is stored on the recording and storage device.

12. An article comprising a storage medium, the storage medium having a set of instructions, the set of instructions being capable of being executed by at least one processor to implement a method for automating input of device control commands and/or parameter changes on a printing press, the set of instructions when executed comprising:

recording at least one sequence of device control command and/or parameter change inputs;

playing back the recorded sequence of device control command and/or parameter change inputs so as to control the printing press;

entering the at least one sequence of device control command and/or parameter change inputs via a graphical user interface (GUI); and assigning each of the recorded at least one sequence of device control command and/or parameter change inputs to an associated predetermined playback button for initiating the playing back of the associated at least one sequence of device control command and/or parameter change inputs.

13. The method as recited in claim 12 wherein the at least one sequence of parameter change inputs are recorded in a file on the storage medium, the storage medium being at least one of a magnetic disc, a magnetic tape and an optical disk.

* * * * *